US005203675A

United States Patent [19]

Marini

[11] Patent Number: 5,203,675

[45] Date of Patent: Apr. 20, 1993

[54] VARIABLE-PITCH PROPELLER HAVING FEATHERING BLADES

[75] Inventor: Fernando Marini, Cassano Magnago, Italy

[73] Assignee: Santa Caterina di Brena ADA & C. S.a.S., Italy

[21] Appl. No.: 757,655

[22] Filed: Sep. 6, 1991

[30] Foreign Application Priority Data

Sep. 19, 1990 [IT] Italy ..... 21513 A/90

[51] Int. Cl.[5] ..... B63H 3/02

[52] U.S. Cl. ..... 416/140; 416/142; 416/208; 416/214 R

[58] Field of Search ..... 416/140, 142, 147, 153, 416/159, 204 R, 205, 207, 208, 214 R

[56] References Cited

U.S. PATENT DOCUMENTS

| | | | |
|---|---|---|---|
| 1,520,746 | 12/1924 | Boyce et al. | 416/140 |
| 2,396,630 | 3/1946 | Anderson | 416/147 |
| 2,477,944 | 8/1949 | Rouse | 416/140 |
| 3,403,735 | 10/1968 | Langhjelm et al. | 416/208 |
| 4,047,841 | 9/1977 | Laurin | 416/140 |
| 4,140,434 | 2/1979 | Bianchi | 416/140 |

FOREIGN PATENT DOCUMENTS

| | | | |
|---|---|---|---|
| 834207 | 3/1952 | Fed. Rep. of Germany | 416/159 |
| 850857 | 3/1952 | Fed. Rep. of Germany | 416/205 |
| 3901672 | 8/1990 | Fed. Rep. of Germany | 416/153 |
| 2555121 | 5/1985 | France | 416/140 |
| 30819A | 12/1975 | Italy . | |
| 23598A | 5/1976 | Italy . | |
| 878852 | 10/1961 | United Kingdom | 416/142 |
| WO9011221 | 10/1990 | World Int. Prop. O. . | |

*Primary Examiner*—Edward K. Look
*Assistant Examiner*—James A. Larson
*Attorney, Agent, or Firm*—Laff, Whitesel, Conte & Saret

[57] ABSTRACT

A propeller to be used in particular for sail boats comprises a hub (2) fitted to the end of a drive shaft (5) and carrying a bevel toothing (8) meshing with bevel pinions (9) provided at the ends of corresponding propeller blades (10) mounted in a rotatable manner about their own axes between two annular shell halves (11, 12) covering the hub (2); and an adjusting element (21) coupled through cylindrical mating toothings (19) to the inner shell half (12) and detachably fastened thereto, the adjusting element internally carrying a circular sector (24) to be engaged by a corresponding circular sector (23) projecting from the outer hub outline so as to determine the boundary orientation positions of the blades (10); the propeller pitch being adjustable by disengagement of the mating toothings (19) between the adjusting element (21) and shell half (12), rotation of the adjusting element through a given angle and further engagement between the mating toothings (19).

10 Claims, 2 Drawing Sheets 1
16
18
15
11
7
A
12
6
8
20
B
23
3
4
17
9
14
10
A
13
19
B
21
2
22
5

14
10
8
12
13
15
15
13
10
9
6
9
15
13
10
14
9
7
9
14

24
20
25
23
25
21
3
4
20
2
23
25
20
5

VARIABLE-PITCH PROPELLER HAVING FEATHERING BLADES

FIELD AND BACKGROUND OF THE INVENTION

The present invention relates to a propeller having adjustable (or variable-pitch) feathering blades, particularly for use in sail boats.

Propellers of the above type have already been known in the art and in these propellers che feathering character of the blades is necessary in order to reduce as much as possible the resistance thereof to the boat moving forward when said boat is pushed by other propulsory means such as, in this case, the sails. In addition, the possibility of varying the blade orientation, that is the propeller pitch is an essential feature for optimizing the propeller efficiency, based on the mechanical characteristics of the propulsor used and the hydrodynamic characteristics of the boat.

Therefore in propellers of this type there is the presence of means enabling the blades to be automatically adjusted to the previously set correct positions for the two directions of rotation of the propulsor's drive shaft corresponding to the forward and reverse speed respectively.

These known propellers usually comprise a hub fixedly mounted to the end of the drive shaft and externally carrying a bevel pinion with which respective bevel pinions mesh, the axes of which are perpendicular to the hub axis and which are provided at the end of the propeller blades and surrounded by a multi-section shell covering the hub.

The hub can freely rotate within said shell making the blades rotate about their own axes in either direction through a given predetermined angle, and is subsequently brought into engagement with the outer shell driving it in rotation integrally therewith. The stroke stops disposed between the hub and the shell therefore define the orientation of the blades, that is the propeller pitch in the two directions of rotation of the drive shaft corresponding to the boat movements.

In some propellers of the above type the stroke stops disposed between the hub and the outer shell cannot be modified and consequently they do not enable the propeller to be adapted to different propulsors and/or boats.

In other known propellers it is possible to modify the angular positions of said stroke stops and, as a result, the propeller pitch, but in this case it is necessary to resort to the propeller dismantling and remounting, which needs the boat to be beached.

In addition, also available are variable-pitch propellers having feathering blades, in which the propeller pitch can be modified without resorting to the complete dismantling thereof and therefore without being obliged to beach the boat.

For example the Italian Patent Application No. 83647-A/87 filed on Aug. 11, 1987 describes a variable-pitch propeller having feathering blades, in which the propeller pitch can be modified by acting on the end of a rod issuing from the ogive-shaped end portion of the propeller and connected, at the other end thereof, to the hub fitted to the drive shaft.

Such an embodiment is rather complicated and a great number of components are required so that the adjustment of the propeller pitch may be carried out. In addition, in this embodiment the outer shell covering the hub consists of longitudinal sectors to be coupled and fixed by means of tangentially-disposed screws. Such a conformation of the shell in the long run can give rise to breaks or at least untightenings involving infiltrations that may be damaging for a good operation of the propeller.

SUMMARY OF THE INVENTION

The object of the present invention is to provide a variable-pitch propeller having feathering blades, in which the propeller pitch can be adjusted from the outside, said propeller also being of compact and easy construction from a mechanical point of view, having a reduced weight and allowing the propeller pitch to be adjusted in a very simple manner.

The above object is attained by a variable-pitch propeller having feathering blades, in particular for sail boats, comprising a hub fitted on a drive shaft of a propulsory means and exhibiting a bevel pinion meshing with bevel pinions provided at the end of respective propeller blades mounted rotatably about their own axes within a shell covering the hub, means being provided to enable an angular displacement of the hub within the shell and rotatably engage with each other respective circular sectors formed on the outer outline of the hub and the inner outline of the shell respectively, as well as means designed to adjust said angular displacement of the hub with respect to the covering shell, wherein said adjusting means consists of an element fitted on the hub and attached releasably to said shell at the inner part thereof, said element internally carrying said circular sector adapted to be engaged to the circular sector provided on the hub.

In particular, the hub-covering shell is formed of a front and a rear annular shell halves having opposite semicircular housings for receiving pinion shanks of the blades. Fastened to the front shell half is the ogive-shaped point of the propeller, while the rear shell half carries an outer circumferential toothing meshing with a corresponding toothing belonging to an adjusting element axially movable relative to said rear portion by untightening securing screws.

BRIEF DESCRIPTION OF THE DRAWINGS

Further features and advantages of the invention will become more apparent from the following detailed description of a preferred embodiment given by way of non-limiting example with reference to the accompanying drawings, in which.

DESCRIPTION OF THE PREFERRED EMBODIMENT

Figure 1:
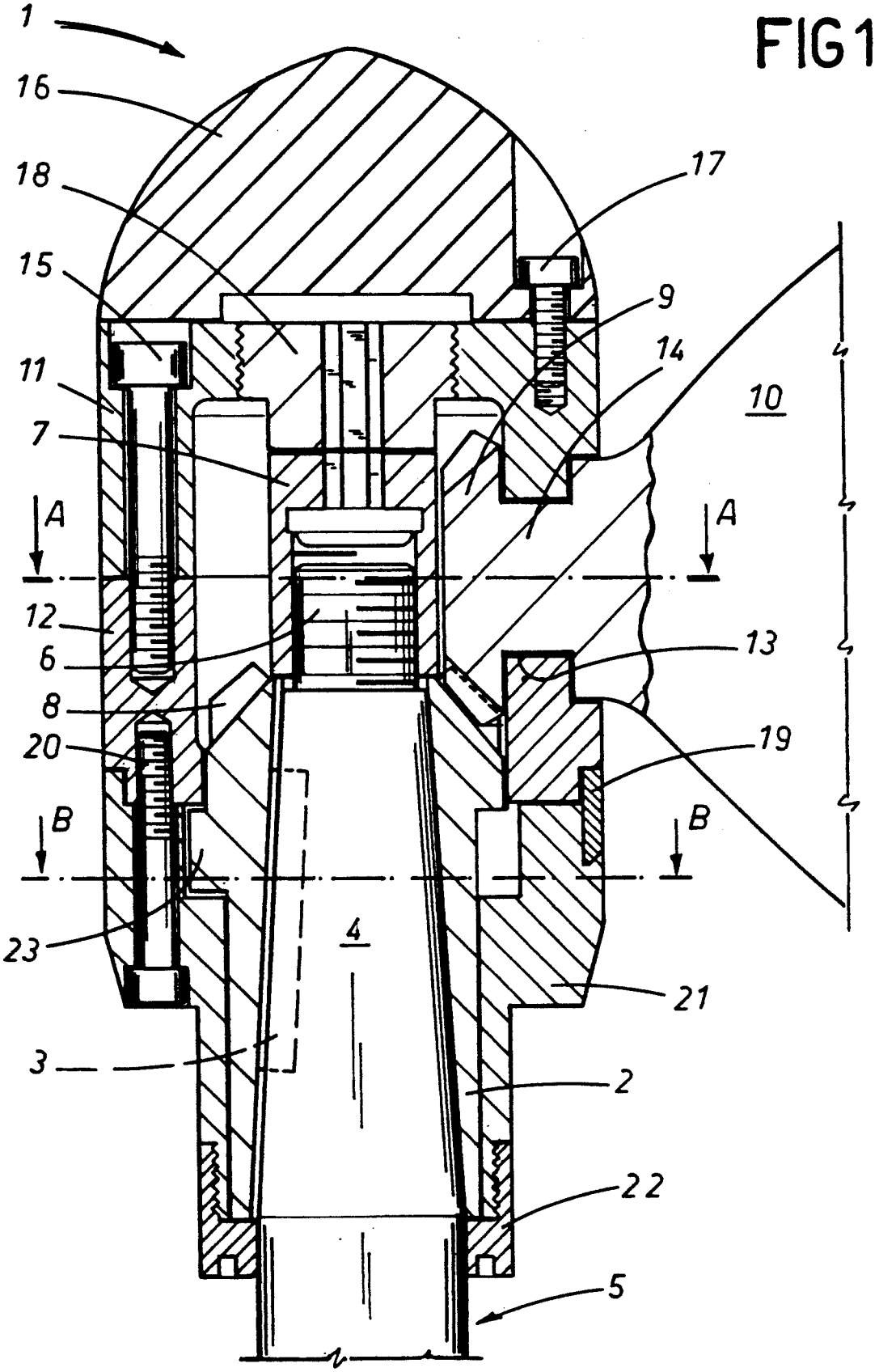
FIG. 1 is a partly longitudinal sectional view of a variable-pitch propeller having feathering blades in accordance with the invention.
Figure 2:
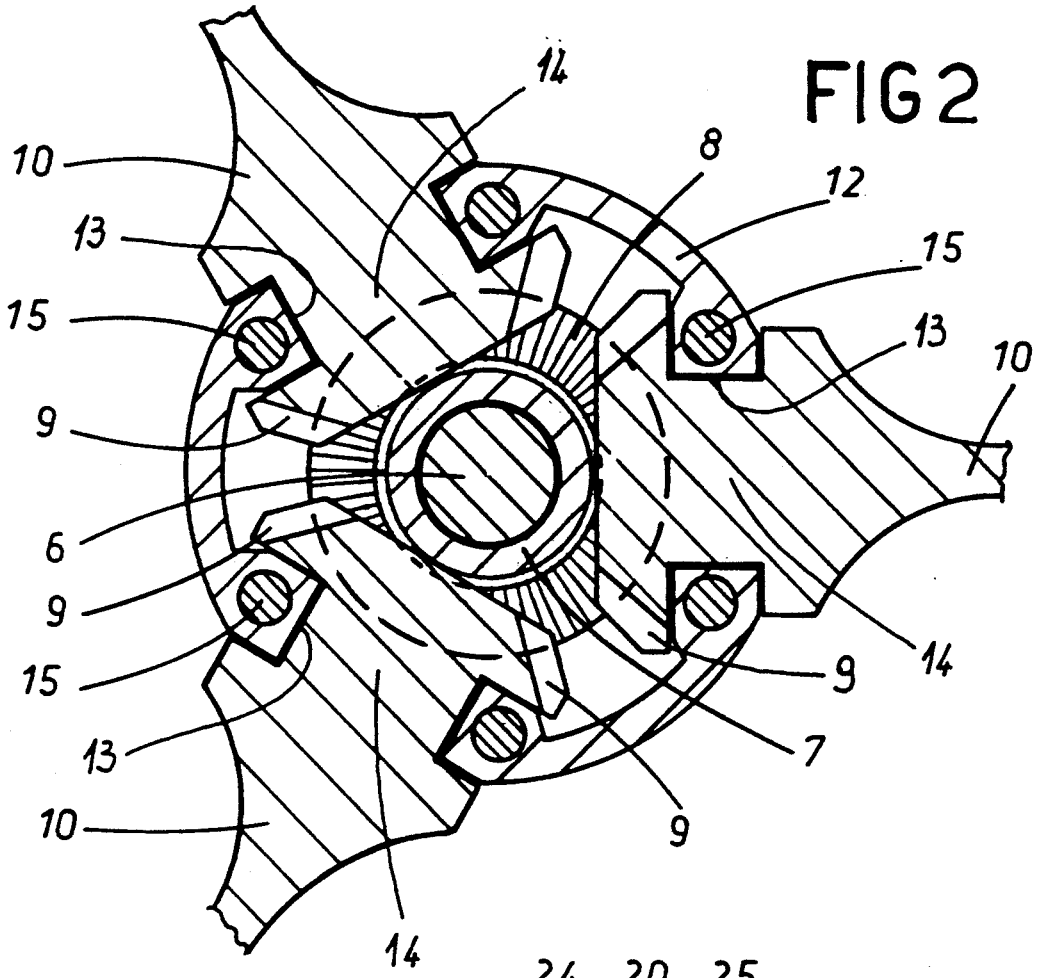
FIG. 2 shows a section taken along line A—A in FIG. 1.

Referring to the drawings, reference numeral 1 generally denotes a variable-pitch propeller having feathering blades, in accordance with the invention. It comprises a hub 2 fitted by a key 3 for example, to the conical end 4 of a drive shaft 5. The shaft 5 projects beyond the hub 2 by a threaded extension 6 on which a stop nut 7 is screwed.

Provided on the hub 2 is a bevel toothing 8 meshing with bevel pinions 9 provided at the base of respective blades 10, three in number for example, disposed circumferentially and spaced apart from one another through 120°.

The blades 10 are held in place by a shell embracing the hub 2 and consisting of a front annular shell half 11 and a rear annular shell half 12 which, when coupled to each other, define holes 13 for respectively receiving short cylindrical shanks 14 of the blade pinions 9. In this way the blades 10 can rotate about their own axes within the shell holes 13, the bevel pinions 9 meshing with the bevel toothing 8 of the hub.

The two shell halves 11 and 12 are fastened to each other by axial fastening screws 15. Secured to the front or outer shell half 11, still by means of auxiliary axial screws 17, is an ogive-shaped end portion 16 upon interposition of a lock nut 18 between said shell half 11 and the stop nut 7 of the hub 2.

Secured to the rear or inner shell half 12 is an adjusting element 21 rotatably engaged to the hub 2. A gear coupling 19 is operatively disposed between the rear shell half 12 and the adjusting element 21 to lock rotations between themselves. Such a gear coupling 19 consists of cylindrical mating toothings carried circumferentially by the rear shell half 12 and the adjusting element 21 respectively. Only one of such toothings, joined with the adjusting element 21, is schematically shown in FIG. 1. Axial securing screws 20 are provided to lock releasably axial movements of the adjusting element 21, as will hereinafter appear. A flange 22 designed to axially lock the hub 2 is screwed to the inner end of the adjusting element 21.

Figure 3:
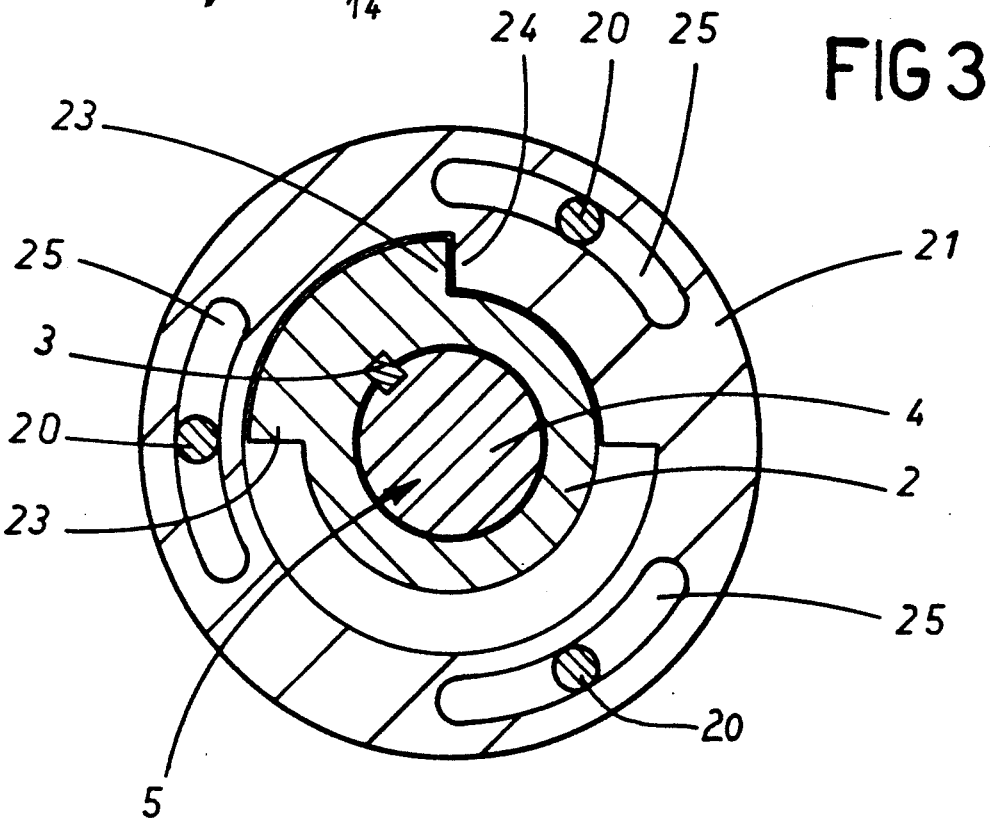
FIG. 3 is a sectional view taken along line B—B in FIG. 1.

The rotatory motion of the hub 2 is transmitted to the inner shell 12 and therefore to the propeller blades 10 by a first circular sector or tooth 23 projecting outwardly from the hub outline, as more clearly shown in FIG. 3, and engaging with a corresponding second circular sector or tooth 24 projecting inwardly from the adjusting element 21 (FIG. 3).

In the position shown in FIG. 3 the two circular sectors 23 and 24 are in abutment against each other so that a clockwise rotation of the drive shaft 5 and therefore the hub 2 corresponding to the forward speed of the boat for example, produces a rotation in the same way of the adjusting element 21 and consequently of the shell halves 11, 12 and the propeller blades 10. The position of the first sector 23 shown in FIG. 3 corresponds to a given orientation of the blades 10, that is to the optimal propeller pitch for a forward speed.

When the drive shaft 5 rotates in the opposite way, that is carries out a counter-clockwise rotation with reference to FIG. 3, the bevel toothings 8 of the hub 2 will cause the blades 10 to rotate through a given angle, meshing with the corresponding bevel pinions 9 so that they will take the optimal orientation for a reverse speed at the time that the first sector 23 comes in abutment with the second sector 24 on the opposite side with respect to the one shown in FIG. 3, thereby dragging along in rotation the rear shell 12 and consequently the propeller blades 10.

When there is no propulsion on propeller 1, that is when the drive shaft 5 idles and therefore rotates freely, for example when the boat is sail pushed, upon the action of a hydraulic thrust the blades 10 will take the position of minimum resistance rotating about their own axes and also causing the hub 2 to rotate by meshing of bevel pinions 9 with the bevel toothings 8.

The flattened position of the blades 10 approximately corresponds to the median position relative to the two limit positions for the forward and reverse speeds, determined by the angular position of sectors 23 and 24.

In order to vary the propeller pitch, that is the position of blades 10 in the conditions of forward and reverse speed, in accordance with the invention, it is sufficient to loosen the securing screws 20 that fasten the adjusting element 21 to the rear shell half 12, so that toothings forming the gear coupling 19 can be disengaged and the adjusting element 21 can be rotated through the desired angle, which brings about the angular displacement of the second circular sector 24 and therefore enables the position of end of stroke of the first sector 23 to be modified.

The rotation of the adjusting element 21 is permitted due to the fact that the securing screws 20 are housed in slots 25 of circular outline provided in the element 21. When the adjustment has been completed toothings forming the gear coupling 19 are brought into engagement again and the securing screws 20 are tightened.

It is to be noted that the threaded portions of the screws 20 engaged with the rear shell half 12 have a longitudinaly dimension greater than the longitudinal dimensions of the toothings which forms the gear coupling 19. From what said above, it is possible to disengage the toothings of coupling 19 without requiring the complete removal of the securing screws 20 and of the adjusting element 21, but just by means of a partial loosening of the screws themselves.

From the foregoing it appears that the propeller of the invention enables the pitch to be easily modified without resorting to the dismantling thereof and therefore without being obliged to beach the boat, by means of very simple and quick operations carried out directly on the adjusting element 21.

Obviously the invention is not limited to the embodiment described and shown in the drawings and modifications and variations can be made without departing from the scope of the invention idea.

What is claimed is:

1. A variable pitch-propeller having feathering blades, in particular for sail boats, comprising:

a hub fitted on a drive shaft of a propulsory means;

a shell embracing rotatably the hub, propeller blades mounted rotatably about their own axes within said shell;

a bevel toothing provided on the hub and meshing with bevel pinions carried by each of said propeller blades;

an adjusting element rotatably engaged on the hub;

a first circular sector connected to and projecting outwardly from the hub;

a second circular sector projecting inwardly from the adjusting element and designed to engage the first circular sector to transmit a rotatory motion from the hub to the shell;

a gear coupling having mating toothings carried respectively by one end of the shell and the adjusting element and meshing together to lock rotation between the shell and the adjusting element;

axial securing screws housed in slots of circular outline formed in said adjusting element and engaging said shell one end by threaded portions in said shell one end, and said axial screws may be loosened to allow reciprocal disengagement of the mating toothings and rotation of the adjusting element with respect to the shell.

2. The propeller as claimed in claim 1, characterized in that said axial screws engage the shell by the threaded portions having a longitudinal dimension greater than the longitudinal dimension of said toothings.

3. The propeller of claim 2 wherein an ogive-shaped end portion is fastened to a front portion of the shell by means of screws.

4. The propeller as claimed in claim 1, wherein said shell is comprised of two annular shell halves to be axially fixed to each other by means of screws.

5. The propeller as claimed in claimed 4, wherein said annular shell halves are provided with semicircular opposite annular portions which on coupling will define holes for receiving shanks of the blade bevel pinions.

6. The propeller of claim 2, wherein an ogive-shaped end portion is fastened to a front portion of the shell by means of screws.

7. A variable pitch-propeller having feathering blades, comprising:

a hub fitted on a drive shaft of a propulsory means;

a shell rotatably embracing the hub, said shell having a front annular shell half and a rear annular shell half axially fixed to each other;

propeller blades mounted rotatably about their own axes through respective holes defined by the shell;

a bevel toothing provided on the hub and meshing with bevel pinions carried by each of said propeller blades;

an adjusting element rotatably engaged on the hub;

a first circular sector connected to and projecting outwardly from the hub;

a second circular sector projecting inwardly from the adjusting element and designed to engage the first circular sector to transmit a rotatory motion from the hub to the shell;

a gear coupling having mating toothings carried respectively by the rear shell half and the adjusting element and meshing together to couple the shell and the adjusting element;

axial securing screws housed in slots of circular outline formed in said adjusting element and engaging the rear shell half by threaded portions to lock axial movement of the adjusting element, said screws having a longitudinal dimension greater than the longitudinal dimension of said mating toothings, and wherein said axial axial screws may be loosened to allow reciprocal disengagement of the mating toothings and rotation of the adjusting element with respect to the shell.

8. The propeller of claim 7 wherein said annular shell halves are provided with semicircular opposite annual portions which on coupling will define said holes for receiving shanks of the blade bevel pinions.

9. The propeller of claim 7 wherein an ogive-shaped end portion is fastened to said front annular shell half by means of screws.

10. A process for modifying the pitch of a variable-pitch propeller having a shell embracing rotatably a hub fitted on a drive shaft, and adjusting element rotatably engaged on the hub and coupled with the shell by a gear coupling having mating toothings carried respectively by a rear shell and the adjusting element, and axial securing screws housed in slots of circular outline formed in the adjusting element, said process comprising the steps of:

loosening the securing screws;

axially shifting said adjusting element until said toothings are disengaged from each other;

rotating said adjusting element through a desired angle:

moving said adjusting element in the opposite way relative to the shifting step bringing said toothings again into mutual engagement; and tightening again said securing screws.

* * * * *